US006876246B2

(12) United States Patent
Kim

(10) Patent No.: US 6,876,246 B2
(45) Date of Patent: Apr. 5, 2005

(54) HIGH VOLTAGE CONTROLLER FOR SEMICONDUCTOR DEVICE

(75) Inventor: Yong-Ki Kim, Ichon-shi (KR)

(73) Assignee: Hynix Semiconductor Inc. (KR)

( * ) Notice: Subject to any disclaimer, the term of this patent is extended or adjusted under 35 U.S.C. 154(b) by 0 days.

(21) Appl. No.: 10/621,186

(22) Filed: Jul. 15, 2003

(65) Prior Publication Data

US 2004/0046604 A1 Mar. 11, 2004

(30) Foreign Application Priority Data

Sep. 9, 2002 (KR) ..... 10-2002-0054158

(51) Int. Cl.[7] ..... G05F 1/10
(52) U.S. Cl. ..... 327/536
(58) Field of Search ..... 327/530, 534, 327/535, 536, 537

(56) References Cited

U.S. PATENT DOCUMENTS 6,522,193 B2 * 2/2003 Shin ..... 327/536
6,700,434 B2 * 3/2004 Fujii et al. ..... 327/534
6,765,428 B2 * 7/2004 Kim et al. ..... 327/534

* cited by examiner

*Primary Examiner*—Jeffrey Zweizig
(74) *Attorney, Agent, or Firm*—Blakely Sokoloff Taylor & Zafman

(57) ABSTRACT

A device for controlling a high voltage to prevent efficiency from dropping by using a detector which detects unstable state of a supply voltage supplied from external circuit and accelerates internal operation of a system in a case that the supply voltage is unstable. The device for controlling the high voltage includes an external voltage detector, a voltage level detector, a generator and a pump.

6 Claims, 6 Drawing Sheets

HIGH VOLTAGE CONTROLLER FOR SEMICONDUCTOR DEVICE

FIELD OF INVENTION

The present invention relates to a high voltage controller for use in a semiconductor device; and, more particularly, to the high voltage controller for supplying a high voltage to a system so as to enhance its performance at an input of an operational voltage under a predetermined level.

DESCRIPTION OF RELATED ART

Generally, a semiconductor device is made in shape of a chip which has discriminated blocks and functions for special object. Also, most of semiconductor devices are mounted on a board, e.g., a printed circuit board PCB, and get operational voltages such as VCC, VDD and so on from the board.

The operational voltage has several kinds of voltage levels, for example, 5.0V, 3.3V, 2.5V, and so on. When the semiconductor device is operated, the semiconductor device is not always supplied with a stable operation voltage because of power noise in a power supply or a system. Generally, the operation voltage is supplied in a range of about 90% to about 110% of a rated voltage. So, in layout of a semiconductor device, it is critical problem how to control an unstable operational voltage. In addition, though an external voltage supplied from the power supply or the system is guaranteed in above ranges, an internal voltage inside the semiconductor device may be not guaranteed in the ranges of about 90% to about 110% of a predetermined internal voltage.

For example, in a dynamic random access memory DRAM, if operation voltage VDD is determined about 2.5 V, the operation voltage VDD should be varied in range of about 2.3 V to about 2.7 V. However, if the external operation voltage is decreased, the internal operation voltage is also weakened. Actually, though about 2.3 V operation voltage is allowable, it is not sufficient to operate DRAM in a normal speed. In contrast, if the operation voltage is 2.7V, the DRAM is faster operated than in about 2.3 V operation voltage. The high performance memory device has strength and weakness. As the strength, the memory device may be operated on high speed. However, as the weakness, the memory device may consume large power. If the DRAM has more devices and circuits for reinforcing a performance of the DRAM, consumption power of the DRAM is increased. Thus, if the internal operation voltage is increased when the DRAM uses a low external operation voltage, performance of the DRAM is improved.

FIG. 1 is a block diagram showing a conventional high voltage controller in accordance with a prior art. The high voltage controller includes a voltage level detector 110, a generator 120, and a pump 130. The voltage level detector 110 generates and outputs a generator enable signal ENABLE for enabling the generator 120 in case that a voltage level is under a predetermined reference voltage. The generator 120 receives the generator enable signal ENABLE from the voltage level detector 110 and generates a periodic signal OSC. The pump 130 receives the periodic signal OSC and generates a internal voltage VPP.

FIG. 2A is a schematic diagram showing a generator 120 of the high voltage controller shown in FIG. 1. The generator 120 includes a NAND gate 201 and first to fifth inverters 202 to 205.

The NAND gate 201 receives the control signal ENABLE outputted from the voltage level detector 110 and an outputted signal of the forth inverter 205 and outputs a result of NAND operation to the first inverter 202. The first to fifth inverters 202 to 206 are serially connected to each other. The last fifth inverter outputs the periodic signal OSC.

FIG. 2B is a schematic diagram showing the pump 130 of the high voltage controller in shown in FIG. 1. The pump 130 includes sixth and seventh inverters 211 and 212, a first capacitor 213, a first diode 214, a second diode 215, and a second capacitor 216.

The sixth inverter 211 receives the periodic signal OSC outputted from the generator 120 and outputs the inverted signal to the seventh inverter 212. The seventh inverter 212 inverses the outputted signal of the sixth inverter 211. The first capacitor 213 is allocated between the seventh inverter 212 and a node 'BT'. The node 'BT' connects the first capacitor 213 to a negative terminal of the first diode 214 and a positive terminal of the second diode 215. A positive terminal of the first diode 214 is coupled to an external supply voltage VDD. The internal voltage VPP is outputted from a negative terminal of the second diode 215 connected to the second capacitor 216. Herein, the first and the second capacitors 213 and 216 serve as a charging and discharging function.

FIG. 2C is a schematic diagram showing the voltage level detector 110 of the high voltage controller shown in FIG. 1. The voltage level detector 110 includes first and second resistors 221 and 222, a differential amplifier 223, and a eighth and a ninth inverters 224 and 225.

The first and second resistors 221 and 222 are serially connected to each other so as to generate a first reference voltage. The first reference voltage outputted between two resistors 221 and 222 is inputted to gate of a first NMOS transistor N1 in the differential amplifier 223. A core voltage Vcore is inputted to gate of a second NMOS transistor N2 in the differential amplifier 223. The differential amplifier 223 compares the first reference voltage with the core voltage Vcore and outputs the higher voltage to the eighth inverter 224. The eighth inverter 224 inverses the outputted voltage of the differential amplifier 223 and, then outputs the inverted voltage to the ninth inverter 225. The ninth inverter 225 outputs an inverted signal ENABLE to the generator 120 after inversing the outputted voltage of the eighth inverter 224.

In the conventional high voltage controller, a delay value between activations of the RAS signal and the CAS signal must be increased for lengthening the tRCD if the activation of the RAS signal is not guaranteed. The tRCD section represents a time from activation of a RAS signal to activation of a CAS signal. Herein, the activation of the CAS signal means a reading or writing operation of the semiconductor device. A critical value of factors which determine the tRCD section is a word line operation voltage, i.e., the internal voltage VPP. The internal voltage VPP is made by bootstrapping or pumping the external supply voltage VDD. The external supply voltage VDD is not effective in a case that the external supply voltage VDD is inputted under a predetermined voltage level. As a result, if the internal supply voltage VPP is lower than a predetermined voltage level, there is occurred a critical problem that the tRCD section is not guaranteed. Namely, an insufficient internal voltage VPP makes a critical problem that operating speed of the device is decreased.

SUMMARY OF INVENTION

It is, therefore, an object of the present invention to provide a high voltage controller for controlling an input operational voltage to thereby effectively maintain an internal operational voltage for a semiconductor device without any affection for the unstable input operational voltage.

In accordance with an aspect of the present invention, there is provided the device for controlling the high voltage includes an external voltage detector for receiving an external supply voltage and generating a low voltage signal in case that the external supply voltage level is under a predetermined voltage level; a voltage level detector for receiving a high voltage which activates a word line and sensing its voltage level and generating a generator enabling signal in case that the high voltage level is under a reference voltage level, the larger reference voltage is applied to that if the low voltage signal is inputted from the external voltage detector; a generator for receiving the generator enabling signal from the voltage level detector and the low voltage signal from the external voltage detector and generating a periodic signal in response to the generator enabling signal and the low voltage signal; and a pump for generating and outputting a high voltage by carrying the external supply voltage through a diode and bootstrapping it, after receiving an output signal of the generator.

BRIEF DESCRIPTION OF DRAWINGS

The above and other objects and features of the present invention will become apparent from the following description of preferred embodiments taken in conjunction with the accompanying drawings, in which.

DETAILED DESCRIPTION OF INVENTION

Hereinafter, a device for controlling high voltage according to the present invention will be described in detail referring to the accompanying drawings.

Figure 1:
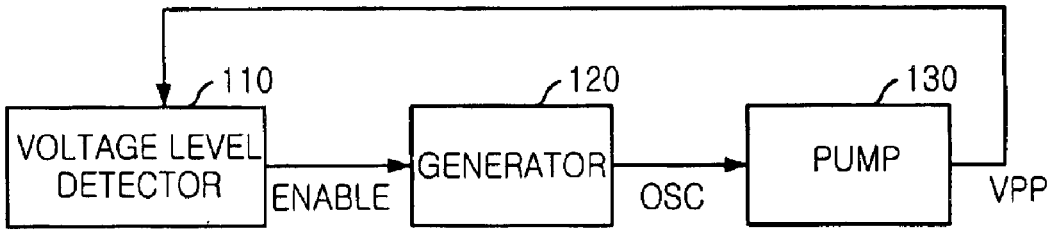
FIG. 1 (PRIOR ART)
FIG. 1 is a block diagram showing a conventional high voltage controller in accordance with a prior art.
Figure 2A:
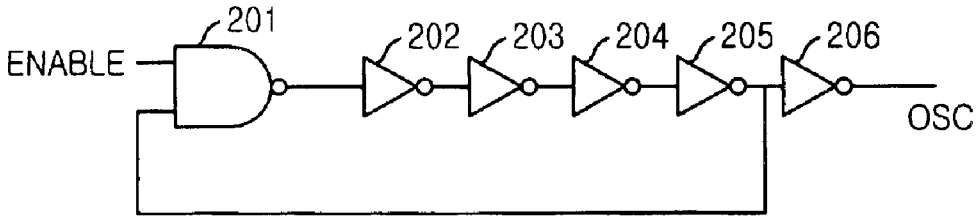
FIG. 2A (PRIOR ART)
FIG. 2A is a schematic diagram showing a generator 120 of the high voltage controller shown in FIG. 1.
Figure 2B:
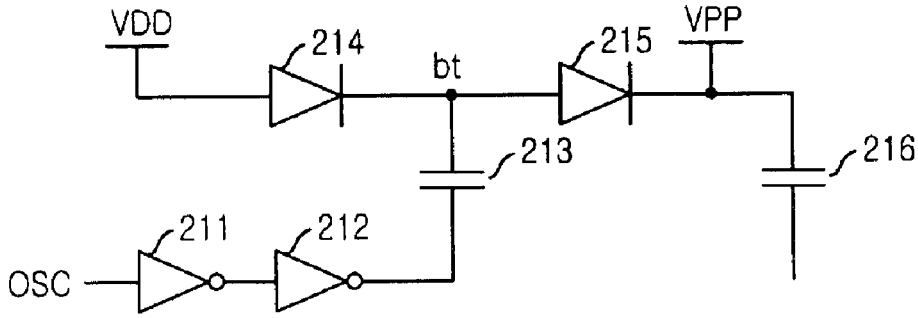
FIG. 2B (PRIOR ART)
FIG. 2B is a schematic diagram showing the pump 130 of the high voltage controller shown in FIG. 1.
Figure 2C:
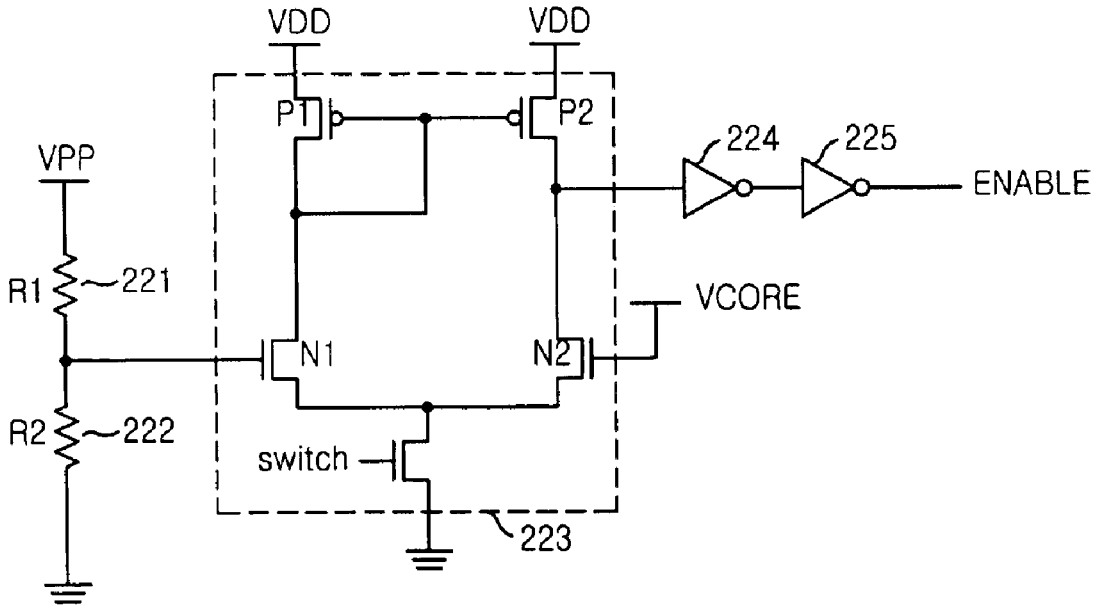
FIG. 2C (PRIOR ART)
FIG. 2*c* is a schematic diagram showing the voltage level detector 110 of the high voltage controller in accordance with the prior art.
Figure 3:
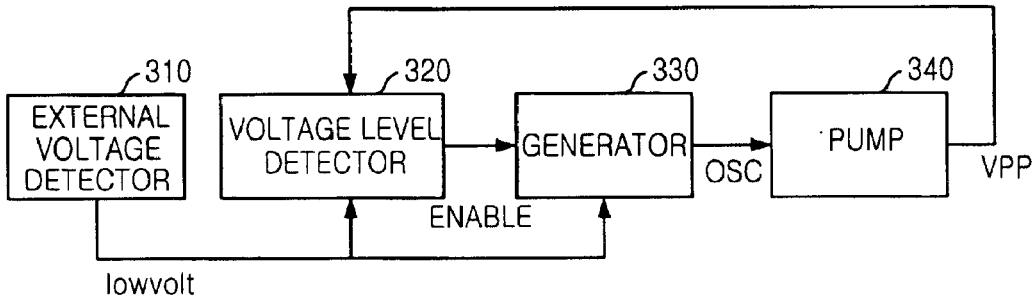
FIG. 3 is a block diagram of a high voltage controller in accordance with a preferred embodiment of the present invention.

FIG. 3 is a block diagram of a high voltage controller in accordance with a preferred embodiment of the present invention. The high voltage controller includes an external voltage detector 310, a voltage level detector 320, a generator 330, and a pump 340.

After receiving an external supply voltage, if the external supply voltage is under a predetermined voltage level, the external voltage detector 310 generates a low voltage signal lowvolt and outputs the low voltage signal lowvolt to the voltage level detector 320 and the generator 330.

Figure 4:
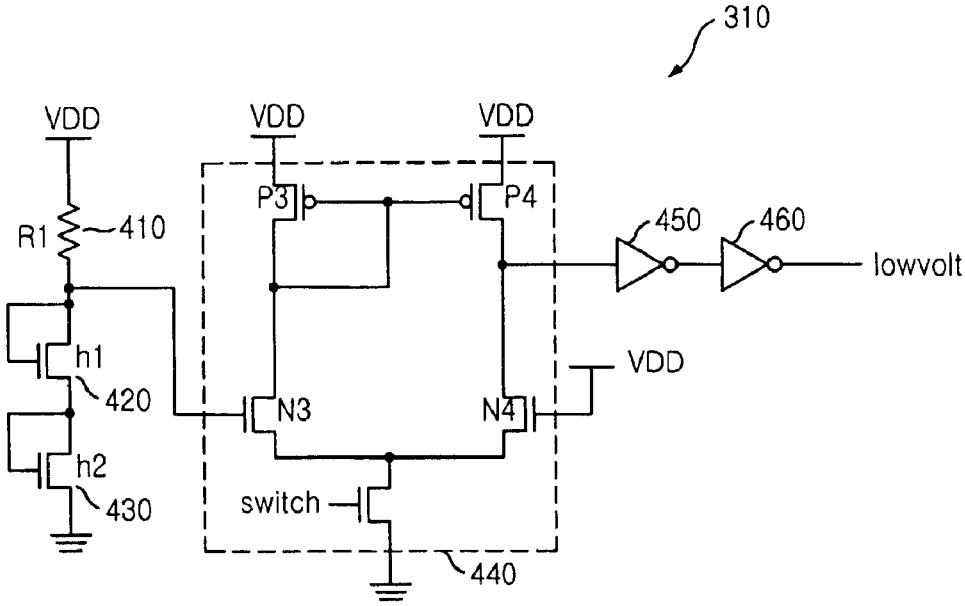
FIG. 4 is a schematic diagram of an external voltage level detector inside the high voltage controller in accordance with a preferred embodiment of the present invention.

The voltage level detector 320 receives an internal voltage VPP which activates a word line and detects its level. If the internal voltage VPP is under a predetermined reference voltage level, a generator enabling signal ENABLE shown in FIG. 4 is generated. Thus, if the low voltage signal lowvolt is inputted from the external voltage detector 310, the predetermined reference voltage is increased.

The generator 330 receives the generator enabling signal ENABLE from the voltage level detector 320 and the low voltage signal lowvolt from the external voltage detector 310 and outputs a periodic signal OSC to the pump 340 in response to the generator enabling signal ENABLE and the low voltage signal lowvolt.

The pump 340 receives the periodic signal OSC outputted from the generator 330 and outputs the internal voltage VPP by bootstrapping an external voltage VDD.

FIG. 4 is a schematic circuit diagram showing the external voltage level detector 310 of the high voltage controller in accordance with a preferred embodiment of the present invention. Hereinafter, there is described several components of the external voltage level detector 310.

A first register 410 is coupled to operation voltage of a word line and provides a constant current as a current source. Drain of a first NMOS transistor 420 is coupled to the first register 410 and the first NMOS transistor 420 is diode-connected by connecting its gate to its drain. Drain of a second NMOS transistor 430 is coupled to source of the first NMOS transistor 420 the second NMOS transistor 430 is and diode-connected by connecting its gate to its drain. Source of a second NMOS transistor 430 is connected to the ground voltage at its source.

In a differential amplifier 440, gate of a third NMOS transistor N3 is coupled to the drain of the first NMOS transistor 420 and gate of a forth NMOS transistor N4 is supplied with the external supply voltage VDD. After comparing two inputted voltages, the differential amplifier 440 outputs a second logic level signal HIGH if the voltage supplied at gate of the third NMOS transistor N3 is larger than the voltage supplied at gate of the forth NMOS transistor N4; and otherwise, the differential amplifier 440 outputs a first logic level signal LOW.

A first inverter 450 inverses the outputted signal from the differential amplifier 440 and outputs the inverted signal to a second inverter 460. The second inverter 460 also inverses an inputted signal, which is outputted from the first inverter 450, and outputs the inverted signal to the voltage level detector 320 and the generator 330.

Figure 5:
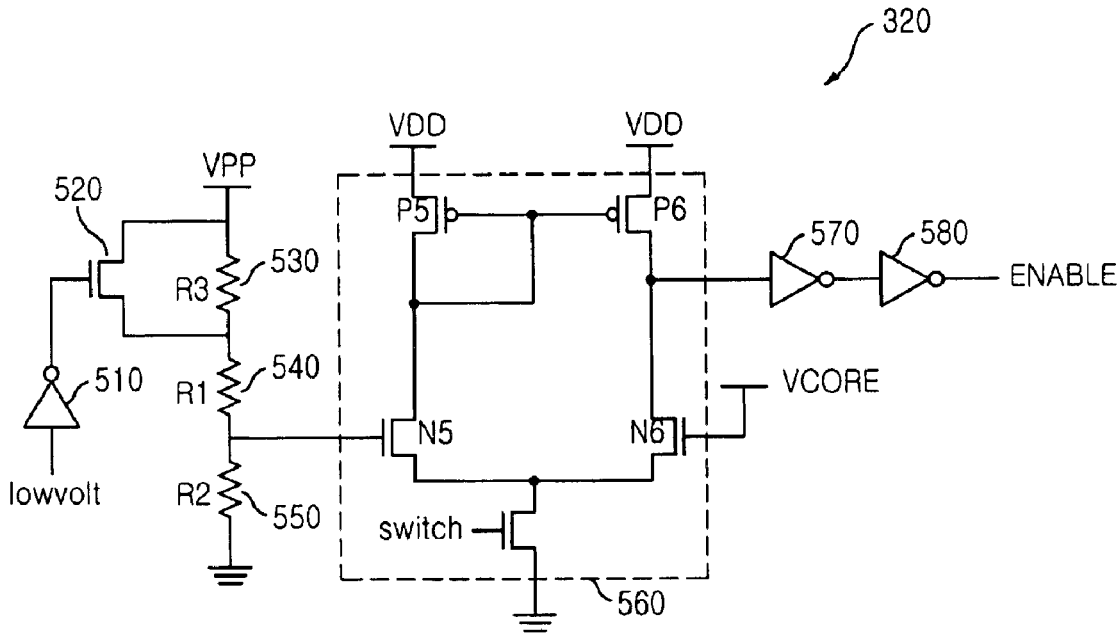
FIG. 5 is a schematic diagram of a voltage level detector inside the high voltage controller in accordance with a preferred embodiment of the present invention.

FIG. 5 is a schematic circuit diagram showing the voltage level detector 320 of the high voltage controller in accordance with the preferred embodiment of the present invention. The voltage level detector 320 includes a third inverter 510, a third NMOS transistor 520, second to forth resistors 530 to 550, a differential amplifier 560, and a forth and a fifth inverters 570 and 580.

The third inverter 510 receives the low voltage signal lowvolt from the external voltage detector 310 and outputs its inversed signal to gate of the third NMOS transistor 520. Drain of the third NMOS transistor 520 is coupled to the operation voltage of the word line. The second resistor 530 is coupled to the drain and source of the third NMOS transistor 520 for providing a resistance. The third and forth resistors are serially connected and the forth resistor is connected to the ground voltage.

In the differential amplifier 560, gate of a fifth NMOS transistor N5 is coupled to a node between the third and forth resistors; and gate of a sixth NMOS transistor N6 is coupled to a core supply voltage. After comparing two inputted voltages, the differential amplifier 440 outputs a second logic level signal HIGH if the voltage supplied at the gate of a fifth NMOS transistor N5 is larger than the voltage supplied at the gate of a sixth NMOS transistor N6; and otherwise, it outputs a first logic level signal LOW. Herein, the core supply voltage serves as activating a data bit stored in a storage node of a cell in a DRAM.

The forth inverter 570 inverses an outputted signal from the differential amplifier 560 and the fifth inverter 580 inverses an outputted signal from the forth inverter 570. The fifth inverter 580 outputs the generator enabling signal ENABLE to the generator 330.

Figure 6:
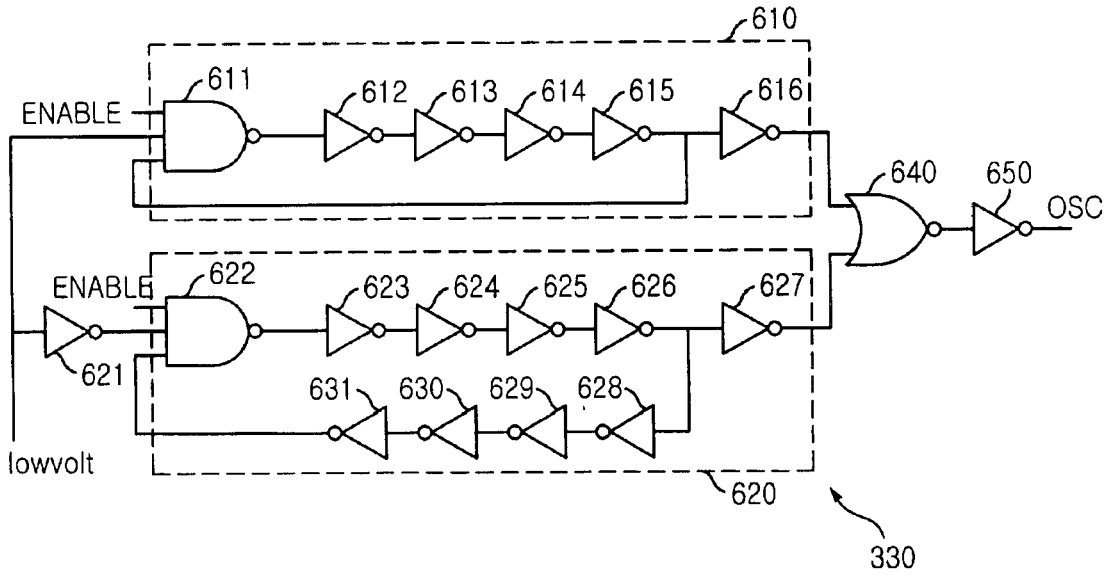
FIG. 6 is a schematic diagram of a generator inside the high voltage controller in accordance with a preferred embodiment of the present invention.

FIG. 6 is a schematic circuit diagram showing a generator 330 of the high voltage controller in accordance with the preferred embodiment of the present invention. The generator 330 includes a first generating logic 610, a second generating logic 620, a NOR gate 640, and a sixth inverter 650.

When the low voltage signal lowvolt is not activated, the first generating logic 610 outputs the first generating signal to the NOR gate 630. The first generating logic 610 includes a first NAND gate 611 and a $7^{th}$ to a $11^{th}$ inverters 612 to 613. The $7^{th}$ to the $11^{th}$ inverters 612 to 613 are serially connected and the $11^{th}$ inverter outputs the first generating signal to the NOR gate 640. The first NAND gate receives the generator enabling signal ENABLE, the low voltage signal lowvolt, and an output signal of the $10^{th}$ inverter.

When the low voltage signal lowvolt is activated, The second generating logic 620 outputs the second generating signal to the NOR gate 630. The second generating signal has a longer period than the first generating signal. The second generating logic 620 includes a second NAND gate 622 and a $13^{th}$ to $17^{th}$ inverters 623 to 631. The $13^{th}$ to the $17^{th}$ inverters are serially connected and the $17^{th}$ inverter outputs the second generating signal to the NOR gate 640. An output signal of the $16^{th}$ inverter is supplied to the second NAND gate through the $18^{th}$ to the $21^{st}$ inverters 628 to 631. The second NAND gate receives the generator enabling signal ENABLE, the inversed low voltage signal/lowvolt, and an output signal of the $21^{st}$ inverter.

The NOR gate 640 receives the first and the second generating signals from the first and second generating logics 610 and 620 and outputs a result of NOR operation to the sixth inverter 650. The sixth inverter 650 inverses the outputted signal from the NOR gate 640 and outputs the periodic signal OSC to the pump 340.

Figure 7:
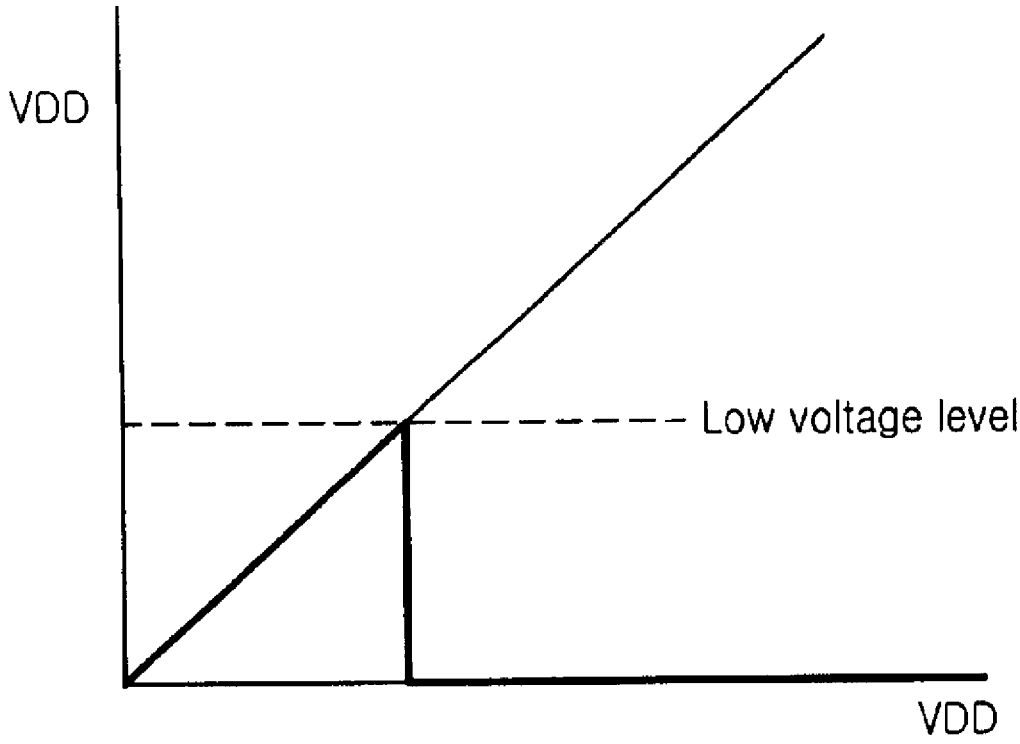
FIG. 7 is a graph showing operation of the high voltage controller in accordance with a preferred embodiment of the present invention.

FIG. 7 is a graph showing operation of the high voltage controller in accordance with the preferred embodiment of the present invention. Hereinafter, referring to FIGS. 3 to 7, there is described operation of the high voltage controller in detail.

In the external voltage detector 310, the external supply voltage VDD is generally varied in ranges of about ±10% of a reference level. If the external supply voltage VDD can be dropped under the low voltage level, performance of a device or a system is dropped. So, the high voltage controller is need for preventing loss of performance. The low voltage signal lowvolt, which is generated from the external voltage detector 310, is generated if the external supply voltage VDD is under a predetermined low voltage level. However, if the external supply voltage VDD is larger than the low voltage level, the low voltage signal lowvolt is not generated.

As above statement, the voltage level detector 320 generates the generator enabling signal ENABLE if the internal voltage VPP which activates the word line is under low voltage level. The generator 330 is operated in response to the low voltage signal lowvolt and the generator enabling signal ENABLE. And the pump 340 generates the internal voltage VPP by bootstrapping the external supply voltage VDD through a diode.

While the present invention has been described with respect to the particular embodiments, it will be apparent to those skilled in the art that various changes and modifications may be made without departing from the spirit and scope of the invention as defined in the following claims.

What is claimed is:

1. A high voltage control circuit for use in a semiconductor device, comprising:

an external voltage detector for receiving an external supply voltage to generate a low voltage signal if the external supply voltage level is under a predetermined voltage level;

a voltage level detector for receiving a high voltage activating a word line to sense a high voltage level and generating a generator enabling signal if the high voltage level is under a reference voltage level, wherein the reference voltage level is increased in response to the low voltage signal;

a generator for receiving the generator enabling signal and the low voltage signal to generate a periodic signal in response to the generator enabling signal and the low voltage signal; and a pump for generating a newly adjusted high voltage in response to the periodic signal.

2. The high voltage control circuit as recited in claim 1, wherein the external voltage detector includes:

a first resistor coupled to a word line operating voltage for serving as a constant current source;

a first NMOS transistor diode-connected for serving as a diode, its drain being coupled to the first resistor and its gate;

a second NMOS transistor diode-connected for serving as a diode, its drain being coupled to its gate and source of the first NMOS transistor and its source being coupled to a ground voltage;

a differential amplifier for comparing two voltages supplied at first and second input terminals and outputting either a second logical signal if the voltage supplied at the first input terminal is larger than the other or a first logical signal if the voltage supplied at the second input terminal is larger than the other, wherein a first input terminal of the differential amplifier is coupled to the drain of the first NMOS transistor and a second input terminal is coupled to the external supply voltage, and wherein the second logical signal is characterized by the first logical signal;

a first inverter for receiving and inverting an output signal of the differential amplifier; and a second inverter for receiving and inversing an output signal of the first inverter and outputting it as the low voltage signal to the voltage level detector and the generator.

3. The high voltage control circuit as recited in claim 1, wherein the voltage level detector includes:

a third inverter for receiving and inversing the low voltage signal from the external voltage detector;

a third NMOS transistor for receiving an output signal of the third inverter at its gate, its drain being coupled to the word line operating voltage;

a second resistor of which each side is individually coupled to the drain of the third NMOS transistor and the source of the third NMOS transistor;

a third resistor coupled to the second resistor;

a forth resistor of which each side is individually coupled to the third resistor and the ground voltage;

a differential amplifier for comparing two voltages supplied at first and second input terminals and outputting either a second logical signal if the voltage supplied at the first input terminal is larger than the other or a first logical signal if the voltage supplied at the second input terminal is larger than the other, wherein its first input terminal is coupled to the third resistor and its second input terminal is coupled to a core supply voltage, and wherein the second logical signal is characterized by the first logical signal;

a forth inverter for receiving and inverting an output signal of the differential amplifier; and a fifth inverter for receiving and inverting an output signal of the forth inverter and outputting the inverted output signal as the generator enabling signal to the generator.

4. The high voltage control circuit as recited in claim 1, wherein the generator includes:

a first generating logic for generating a first generating signal in case that the low voltage signal is not activated;

a second generating logic for generating a second generating signal in case that the low voltage signal is activated, a period of the second generating signal being longer than that of the first generating signal;

a NOR gate for carrying out a NOR operation after receiving output signals of the first and second generating logics; and a sixth inverter for outputting the periodic signal after receiving and inversing an output signal of the NOR gate.

5. The high voltage control circuit as recited in claim 4, wherein the first generating logic includes:

a first NAND gate for carrying out a NAND operation after receiving several signals which at least include the low voltage signal and the generator enabling signal;

a seventh inverter for receiving and inversing an output signal of the first NAND gate;

a eighth inverter for receiving and inversing an output signal of the seventh inverter;

a ninth inverter for receiving and inversing an output signal of the eighth inverter;

a tenth inverter for receiving and inversing an output signal of the ninth inverter and thereon outputting to the first NAND gate; and a eleventh inverter for receiving and inversing an output signal of the tenth inverter and outputting a periodic signal to the NOR gate.

6. The high voltage control circuit as recited in claim 4, wherein the second generating logic includes:

a twelfth inverter for receiving and inversing the low voltage signal;

a second NAND gate for carrying out a NAND operation after receiving several signals which at least include the low voltage signal and the generator enabling signal;

a thirteenth inverter for receiving and inversing an output signal of the second NAND gate;

a fourteenth inverter for receiving and inversing an output signal of the thirteenth inverter;

a fifteenth inverter for receiving and inversing an output signal of the fourteenth inverter;

a sixteenth inverter for receiving and inversing an output signal of the fifteenth inverter;

a seventeenth inverter for receiving and inversing an output signal of the sixteenth inverter and outputting a periodic signal to the NOR gate;

a eighteenth inverter for receiving and inversing an output signal of the sixteenth inverter;

a nineteenth inverter for receiving and inversing an output signal of the eighteenth inverter;

a twentieth inverter for receiving and inversing an output signal of the nineteenth inverter; and a twenty-first inverter for receiving and inversing an output signal of the twentieth inverter and thereon outputting to the second NAND gate.

* * * * *